United States Patent [19]

Kölling et al.

[11] 4,289,604

[45] Sep. 15, 1981

[54] METHOD OF PRODUCING AN ISOTROPIC COKE

[75] Inventors: Georg Kölling, Essen-Bredeney; Gerhard Pietzka, Vockenhausen; Ingo Romey, Hünxe; Harald Tillmanns, Kelkheim, all of Fed. Rep. of Germany

[73] Assignees: Bergwerksverband GmbH, Meitingen; Sigri Elektrographit GmbH, Essen, both of Fed. Rep. of Germany

[21] Appl. No.: 783,030

[22] Filed: Mar. 31, 1977

[30] Foreign Application Priority Data

Apr. 3, 1976 [DE] Fed. Rep. of Germany ..... 2614541

[51] Int. Cl.[3] ..... C10B 55/00

[52] U.S. Cl. ..... 208/106; 423/445; 423/448; 423/449

[58] Field of Search ..... 423/445, 448, 449, 450; 208/106, 8, 14, 39, 50, 131

[56] References Cited

U.S. PATENT DOCUMENTS

| | | | |
|---|---|---|---|
| 2,983,665 | 5/1961 | Dell et al. | 208/39 |
| 3,563,884 | 2/1971 | Bloomer et al. | 208/131 X |

FOREIGN PATENT DOCUMENTS

| | | | |
|---|---|---|---|
| 47-32722 | 8/1972 | Japan | 423/448 |
| 1021929 | 3/1963 | United Kingdom | 423/449 |
| 847840 | 9/1963 | United Kingdom | 423/449 |

*Primary Examiner*—Edward J. Meros
*Attorney, Agent, or Firm*—Herbert L. Lerner

[57] ABSTRACT

Manufacture of isotropic coke by first selecting as feed material tar from low temperature carbonization with a hydrogen content above 5.5%, a carbon content less than 88% and a softening point above 60° C., filtering the tar to remove solid particles, and heating the filtrate to a temperature between about 900° C. and 1300° C. to form an isotropic coke.

2 Claims, No Drawings

METHOD OF PRODUCING AN ISOTROPIC COKE

BACKGROUND OF THE INVENTION

1. Field of the Invention

This invention relates to coke and more particularly refers to a new and improved method for manufacturing an isotropic coke.

2. Description of the Prior Art

The term "isotropic coke" is understood in the following to mean coke, the vectorial physical and chemical properties of which are independent of the direction in space, so that, for example, the thermal expansion coefficient of the coke is the same in all directions. Isotropic coke is especially suitable as a base material, for instance, for manufacturing isotropic carbon and graphite bodies. Such bodies have an advantage over bodies with anisotropic properties for certain applications, particularly where these bodies are part of a support structure.

One isotropic coke is Gilsonite coke which is obtained from natural bitumen but is no longer available in sufficient quantity because the deposits are exhausted. According to the German Pat. No. 2,025,979, aromatic hydrocarbons may also be suitable for producing an isotropic coke. These aromatic hydrocarbons contain three and more rings, one of which has five links, and similar N-, O- or S-heterocycles, in which at least one hetero atom is situated in the five-ring. The aromatic hydrocarbons are carbonized alone or as a mixture at a temperature between 430° and 550° C. and a pressure of 4 to 16 bar. The coke carbonized at the low temperature is then calcined in known manner. Particularly well suited for this purpose are compounds such as acenaphthylene, acenaphthene, fluorene, fluoranthene, carbazole, diphenylene oxide and the like. However, the use of such compounds would hardly seem feasible for the production of isotropic coke on a large scale because of their low tar content. The separation of the hydrocarbons and heterocycles as raw material for coking, as proposed in the Patent, from coal tar asphalt fractions or coal tar pitch by means of sodium or sodium amide melts is expensive. German Published Non-Prosecuted application No. 2,300,023, proposes to produce isotropic carbon from hydrocarbon distillates, e.g. from coal tar, by treating the distillate with a gas containing elemental oxygen, where the oxygen requirement is at least 31 liters per kg of distillate and the treatment temperature is 250° to 420° C. The pitch-like treatment residue is coked in known manner by heating under inert conditions. This method has its advantages insofar as tar is available in sufficient quantity, but the relatively small coke residue, which is about 30 to 50%, is a disadvantage.

SUMMARY OF THE INVENTION

An object of the present invention to provide a method for manufacturing an isotropic coke which permits the use of raw materials readily available in large quantities, yields a high cole residue and a coke with a large thermal volume expansion coefficient, a small degree of anisotropy and a low impurity content.

With the foregoing and other objects in view, there is provided in accordance with the invention a method for manufacturing an isotropic coke, which includes subjecting tar from low temperature carbonization of bitumen, having a hydrogen content of more than 5.5%, a carbon content of less than 88% and a softening point above 60° C., to filtration to remove solid particles therefrom, and heating the filtrate to a temperature between about 900° C. and 1300° C. to convert the filtrate to an isotropic coke.

Other features which are considered as characteristic for the invention are set forth in the appended claims.

Although the invention is illustrated and described herein as embodied in a method of producing an isotropic coke, it is nevertheless not intended to be limited to the details shown, since various modifications may be made therein without departing from the spirit of the invention and within the scope and range of equivalents of the claims.

The invention, however, together with additional objects and advantages thereof will be best understood from the following description.

DETAILED DESCRIPTION OF THE INVENTION

At the outset, the raw material is a tar, sometimes called a tar-pitch or pitch, from low temperature carbonization with a softening point above 60° C., preferably within the range of 60°–90° C., although the melting point may extend to about 140° C., and containing more than 5.5% hydrogen and less than 88% carbon. Such tars contain solid impurities such as inorganic matter and soot-like material, generally in excess of 1.0%.

Tar from low-temperature carbonization is understood in the context of the invention to be tar produced when bituminous substances are heated up to about 700° C., as for example the tars produced in the pressure gasification of coal or the manufacture of molded coke. Because of the low coke yield and the high content of ash-forming impurities, tars from low-temperature carbonization are not considered as a suitable input material for the production of coke and in particular, not as input material for producing coke suitable for making graphite. According to the teachings of the German Published Prosecuted application No. 1,189,517, although it is known to separate the mineral and soot-like ingredients from pitch, pitch distillates and the like by distillation and to produce a low-ash coke by coking the filtrate, the method is not suited for producing an isotropic coke, as these cokes are of an anisotropic nature. Surprisingly, it has been found that tars from low-temperature carbonization, which have been freed from mineral and soot-like impurities by filtration, are an excellent input material for the manufacture of an isotropic coke. The unexpected effect is evidently due to the large hetero atom share of tars from low temperature carbonization and the tendency to condense which results therefrom and by which the development of a quasi-stable mesophase necessary for anisotropic coke textures is inhibited or at least limited. Tars from low-temperature carbonization, which are coked directly without prior separation of the impurities, yield cokes with a high ash content and irregular structure which are not suitable for the manufacture of graphite bodies which are to be used, for example, in nuclear reactors.

For producing isotropic cokes, tars from low-temperature carbonization with a carbon content of less than 88% and a hydrogen content of more than 5.5% are suitable. Tars with a higher carbon content and lower hydrogen content yield cokes with anisotropic structure elements and less isotropy.

The low-temperature tars produced in the gasification of bituminous coal are particularly adapted for producing isotropic cokes. For coking the filtrates of tar from low-temperature carbonization, the known coking and low-temperature carbonizing are employed. A particularly high coke yield is obtained by heating the filtrate to 350° C. with a gradient of 100° to 300° C./hr, from 350° to 460° C. with a gradient of 5° to 50° C./hr and to the maximum calcining temperature with a gradient of more than 50° C./hr. A filtering aid, such as for instance, kieselguhr (diatomaceous earth) is advantageously added to the tar in an amount of 1 to 5% for the filtration of the tar from low-temperature carbonization. Pressure filters such as filter cartridges containing metallic filter inserts with a gap width of about 80 to 150 μm, which permit a pressure of up to about 10 bar may be used for filtering the tar. The temperature of the tar from low-temperature carbonization is advantageously about 100° to 200° C. higher than the softening point of the tar. The attainable filter output is about 200 to 500 kg/m$^2$hr, depending on the grade of tar from low-temperature carbonization and the filtration conditions. The filtrate is coked and the semicoke (or green coke) produced is optionally calcined in a second heating stage.

The characteristic properties of a coke have heretofore been determined principally indirectly by measurements on test bodies which contain, in addition to coke granules of different size, a coked binding agent as a filler. In addition to the relatively long time it takes to prepare the test bodies, the imprecision of the method due to the effect of the preparation parameters is a disadvantage. It is further known to determine the degree of anisotropy of coke qualitatively by observing polished coke samples in reflected light between crossed Nicols. More suitable for characterizing a coke are direct quantitative measurements such as, for instance, determining the thermal expansion coefficient on small cubes cut from larger pieces of coke. With this method, the following values (20° to 200° C.) are determined for known grades of coke:

| | Thermal volume expansion coefficient | Degree of anisotropy $\alpha_{max}\alpha_{min}$ |
|---|---|---|
| Needle coke | 4 to 6 × $10^{-6}$/K | 1.8 |
| Normal oil coke | 6 to 10 × $10^{-6}$/K | 1.5 |
| Coal tar asphalt pitch coke | 12 to 14 × $10^{-6}$/K | 1.4 |
| Gilsonite coke | less than 14 × $10^{-6}$/K | 1.2 |

(α linear thermal expansion coefficient; the coke samples were always heated for 6 hours to 1300° C. prior to the Measurement).

For isotropic coke made from low-temperature coke filtrate, in accordance with the invention, the degree of anisotropy of the linear thermal expansion was less than 1.1 and the thermal volume expansion coefficient was about 13.5×$10^{-6}$/K., and on the average the ash content is about 0.1%. The coke is especially suitable for the manufacture of a graphite, the physical and chemical properties of which are the same in all directions of space and which is used, for instance, as material for moderators and reflectors in high-temperature nuclear reactors.

The following example illustrates the present invention:

A raw tar obtained in the pressure gasification of bituminous coal with 84.4% carbon 5.68% hydrogen 1.5% ash content, and a softening point of 67° C. was heated to a temperature of about 190° C. after 3% kieselguhr had been added, and filtered in a pressure filter at a mean pressure of 5 bar. The filtration output was about 400 kg/m$^2$hr.

The filtrate with an ash content of less than 0.1% was heated in a chamber oven to 350° C. at a rate of about 200° C./hr, from 350° to 460° C. at 10° C./hr and from 460° to about 1000° C. at about 80° C./hr. The coke yield was 64%, the ash content 0.1%, the thermal volume expansion coefficient of the coke was 13.6×$10^{-6}$/K and the ratio of maximum to minimum thermal expansion coefficient was 1.1. Extrusion-molded graphite bodies made from the low-temperature coke were nearly isotropic and exhibited the following linear thermal expansion coefficients (20° to 200° C.):

| | |
|---|---|
| Parallel to the pressing direction | −5.2 × $10^{-6}$/K |
| Perpendicular to the pressing direction | −4.7 × $10^{-6}$/K |
| Degree of anisotropy | −1.11 |

There are claimed:

1. Method for manufacturing an isotropic coke, which comprises subjecting tar from (a) low temperature carbonization of bitumen, (b) having a hydrogen content of more than 5.5%, (c) a carbon content of less than 88% and a softening point above 60° C., to (d) filtration to remove solid particles therefrom, and (e) heating the filtrate to a temperature between about 900° C. and 1300° C., to convert the filtrate to an isotropic coke characterized by a thermal volume expansion coefficient of about 13.5×$10^{-6}$/K and a degree of anisotropy of less than 1.2, (f) wherein said filtrate is heated to 350° C. with a temperature gradient of 100° to 300° C./hr, from 350° to 460° C. with a gradient of 5° to 50° C./hr and from 460° to 900° to 1300° C. with a gradient of more than 50° C./hr.

2. Method according to claim 1, wherein the tar from low-temperature carbonization is formed in the gasification of coal.

* * * * *